US009797031B2

(12) United States Patent
Greven et al.

(10) Patent No.: US 9,797,031 B2
(45) Date of Patent: Oct. 24, 2017

(54) ALUMINUM CASTING ALLOY

(71) Applicant: KSM Castings Group GmbH, Hildesheim (DE)

(72) Inventors: Klaus Greven, Hildesheim (DE); Manikandan Loganathan, Hildesheim (DE); Oliver Grimm, Lehrte/Ahlten (DE); Lutz Wolkenstein, Elze (DE); Heinrich Hanekop, Sarstedt (DE); Stephan Bukowski, Potsdam (DE)

(73) Assignee: KSM Castings Group GmbH, Hildesheim (DE)

( * ) Notice: Subject to any disclaimer, the term of this patent is extended or adjusted under 35 U.S.C. 154(b) by 228 days.

(21) Appl. No.: 13/973,197

(22) Filed: Aug. 22, 2013

(65) Prior Publication Data

US 2014/0056755 A1 Feb. 27, 2014

(30) Foreign Application Priority Data

Aug. 23, 2012 (DE) ..... 10 2012 107 787
Sep. 7, 2012 (DE) ..... 10 2012 108 321

(51) Int. Cl.
*C22C 21/04* (2006.01)
*C22C 21/02* (2006.01)
*C22F 1/043* (2006.01)

(52) U.S. Cl.
CPC ..... *C22C 21/04* (2013.01); *C22C 21/02* (2013.01); *C22F 1/043* (2013.01)

(58) Field of Classification Search
CPC ..... C22C 21/04; C22C 21/02; C22F 1/043
See application file for complete search history.

(56) References Cited

U.S. PATENT DOCUMENTS

| | | | |
|---|---|---|---|
| 2,943,368 | A | 7/1960 | Peras |
| 4,671,342 | A | 6/1987 | Balevski et al. |
| 4,791,977 | A | 12/1988 | Chandley |
| 4,825,772 | A | 5/1989 | Jeffreys |
| 4,825,775 | A | 5/1989 | Stein et al. |
| 4,961,455 | A | 10/1990 | Redemske et al. |
| 5,230,379 | A | 7/1993 | Voss |
| 5,280,957 | A | 1/1994 | Hentschel et al. |
| 5,398,750 | A | 3/1995 | Crepeau et al. |
| 5,482,321 | A | 1/1996 | Soeffge et al. |
| 5,582,659 | A | 12/1996 | Hashimoto et al. |
| 5,601,135 | A | 2/1997 | Merrill |

(Continued)

FOREIGN PATENT DOCUMENTS

| | | |
|---|---|---|
| CN | 101 855 124 A | 10/2010 |
| CN | 102 089 450 A | 6/2011 |

(Continued)

OTHER PUBLICATIONS

DIN 50125, Jul. 2009, pp. 1-14.

(Continued)

*Primary Examiner* — Roy King
*Assistant Examiner* — Janelle Morillo
(74) *Attorney, Agent, or Firm* — Collard & Roe, P.C.

(57) ABSTRACT

An aluminum casting alloy contains
Si: 3.0 wt.-% to 3.8 wt.-%
Mg: 0.3 wt.-% to 0.6 wt.-%
Cr: 0.25 wt.-% to 0.35 wt.-%
Fe: <0.18 wt.-%
Mn: <0.06 wt.-%
Ti: <0.16 wt.-%
Cu: <0.006 wt.-%
Sr: 0.010 wt.-% to 0.030 wt.-%
Zr: <0.006 wt.-%
Zn: <0.006 wt.-%
Contaminants: <0.1 wt.-%, (Continued)

and is supplemented to 100 wt.-%, in each instance, with Al.

33 Claims, 3 Drawing Sheets

(56) References Cited

U.S. PATENT DOCUMENTS

| | | | |
|---|---|---|---|
| 6,132,531 | A | 10/2000 | Fang et al. |
| 8,083,244 | B2 | 12/2011 | Buschjohann et al. |
| 8,286,319 | B2 | 10/2012 | Stolle et al. |
| 8,302,979 | B2 | 11/2012 | Buschjohann et al. |
| 8,333,395 | B2 | 12/2012 | Buschjohann et al. |
| 8,403,347 | B2 | 3/2013 | Eickmann et al. |
| 8,783,331 | B2 | 7/2014 | Heinecke et al. |
| 2005/0155676 | A1 | 7/2005 | Cosse et al. |
| 2005/0224145 | A1 | 10/2005 | Laslaz et al. |
| 2007/0125460 | A1 | 6/2007 | Lin et al. |
| 2008/0296812 | A1 | 12/2008 | Jung et al. |
| 2009/0051154 | A1 | 2/2009 | Eickmann et al. |
| 2010/0038893 | A1 | 2/2010 | Stolle et al. |
| 2010/0163137 | A1 | 7/2010 | Wuerker et al. |
| 2010/0288401 | A1 | 11/2010 | Hennings et al. |
| 2010/0289239 | A1 | 11/2010 | Buschjohann et al. |
| 2010/0289240 | A1 | 11/2010 | Buschjohann et al. |
| 2011/0116966 | A1 | 5/2011 | Kawahara et al. |
| 2012/0104739 | A1 | 5/2012 | Buschjohann et al. |
| 2012/0119461 | A1 | 5/2012 | Heinecke et al. |
| 2012/0222783 | A1 | 9/2012 | Brinkman et al. |
| 2013/0033017 | A1 | 2/2013 | Buschjohann et al. |
| 2013/0168939 | A1 | 7/2013 | Buschjohann et al. |
| 2013/0175780 | A1 | 7/2013 | Eickmann et al. |

FOREIGN PATENT DOCUMENTS

| | | | |
|---|---|---|---|
| DE | 1 178 979 | B | 10/1964 |
| DE | 34 22 121 | A1 | 12/1985 |
| DE | 102006039684 | A1 | 2/2008 |
| DE | 20 2008 017 274 | U1 | 4/2009 |
| DE | 10 2008 055 928 | A1 | 8/2009 |
| DE | 10 2009 012 073 | A1 | 9/2010 |
| DE | 10 2010 026 480 | A1 | 3/2011 |
| EP | 0 221 196 | B1 | 5/1987 |
| EP | 0 253 692 | A1 | 1/1988 |
| EP | 0 398 168 | A1 | 11/1990 |
| EP | 0 564 774 | A1 | 5/1998 |
| EP | 1 270 114 | A1 | 1/2003 |
| EP | 1 304 280 | A2 | 4/2003 |
| EP | 1 386 827 | A2 | 2/2004 |
| EP | 1 413 636 | A1 | 4/2004 |
| EP | 1 733 823 | A1 | 12/2006 |
| EP | 1 787 894 | A2 | 5/2007 |
| GB | 989 353 | A | 4/1965 |
| GB | 1 471 882 | A | 4/1977 |
| JP | 54-013407 | A | 1/1979 |
| JP | 61-235042 | A | 10/1986 |
| JP | 7-109536 | A | 4/1995 |
| JP | 10-110231 | A | 4/1998 |
| JP | 2002-047524 | A | 2/2002 |
| JP | 2004-238739 | A | 8/2004 |
| JP | 2006-161103 | A | 6/2006 |
| JP | 2006-322062 | A | 11/2006 |
| JP | 2010-018875 | A | 1/2010 |
| JP | 2011-505285 | A | 2/2011 |
| WO | 02/26548 | A1 | 4/2002 |
| WO | 2007/025528 | A2 | 3/2007 |
| WO | 2007/031060 | A1 | 3/2007 |
| WO | 2009/059591 | A2 | 5/2009 |
| WO | 2009/059592 | A2 | 5/2009 |
| WO | 2009/059593 | A2 | 5/2009 |
| WO | 2011/003387 | A1 | 1/2011 |
| WO | 2011/003388 | A1 | 1/2011 |
| WO | 2012/059078 | A2 | 5/2012 |

OTHER PUBLICATIONS

DIN EN 10 002, 1990-1991, total of 29 pages.

International Search Report of PCT/DE2012/000240, mailed Aug. 22, 2012, four pages.

Walter, L. et al., "Radfiihrende Bauteile, hergestellt im CPC-Verfahren," vol. 92, No. 9, Jan. 1, 2005, pp. 30-35, XP009139013, ISSN: 0016-9765.

English translation of the International Preliminary Report on Patentability and Written Opinion of the International Searching Authority of PCT/DE2010/000780, Jan. 19, 2012, twelve pages.

International Search Report of PCT/DE2010/000780, mailed Dec. 2, 2010, three pages.

International Search Report of PCT/DE2014/100032, mailed May 20, 2014.

D. H. Herring. "Heat treating of aluminum castings." IndustrialHeating.com Feb. 2010, 22 and 24.

DIN EN ISO 6892-1:2009, Dec. 2009.

International Search Report of PCT/DE2012/100278, mailed Jan. 14, 2014.

International Search Report of PCT/DE2008/001816, dated Jun. 23, 2009.

English translation of the International Preliminary Report on Patentability and Written Opinion of the International Searching Authority of PCT/DE2008/001816, dated Jun. 10, 2010.

John E. Hatch, "Aluminium Properties and Physical Metallurgy," 1984, American Society For Metals, US, Ohio, pp. 340-349, XP-002524400.

ALUMINUM CASTING ALLOY

CROSS REFERENCE TO RELATED APPLICATIONS

Applicant claims priority under 35 U.S.C. §119 of German Application Nos. 10 2012 107 787.8 filed Aug. 23, 2012 and 10 2012 108 321.5 filed Sep. 7, 2012, the disclosures of which are incorporated by reference.

BACKGROUND OF THE INVENTION

1. Field of the Invention

The invention relates to an aluminum (Al) casting alloy.

2. Description of the Related Art

An Al casting alloy is known from DE 10 2008 055 928 A1, which contains the alloy components listed below Si: 2.5 wt.-% to 3.3 wt.-%, preferably 2.7 wt.-% to 3.1 wt.-%
Mg: 0.2 wt.-% to 0.7 wt.-%, preferably 0.3 wt.-% to 0.6 wt.-%
Fe: <0.18 wt.-%, preferably 0.05 wt.-% to 0.16 wt.-%
Mn: <0.5 wt.-%, preferably 0.05 wt.-% to 0.4 wt.-%
Ti: <0.1 wt.-%, preferably 0.01 wt.-% to 0.08 wt.-%
Sr: <0.03 wt.-%, preferably 0.01 wt.-% to 0.03 wt.-%
Cr: 0.3 to 1.3 wt.-%, preferably 0.4 wt.-% to 1.0 wt.-%, particularly preferably 0.5 wt.-% to 0.8 wt.-%
Other: <0.1 wt.-%
and is supplemented to 100 wt.-%, in each instance, with Al.

SUMMARY OF THE INVENTION

Proceeding from this state of the art, the invention is based on the task of further improving such a low-Si Al casting alloy with regard to its mechanical properties.

These and other objects are achieved, according to the invention, by means of an Al casting alloy that contains the alloy components listed below Si: 3.0 wt.-% to 3.8 wt.-%
Mg: 0.3 wt.-% to 0.6
Cr: 0.25 wt.-% to 0.35 wt.-%
Fe: <0.18 wt.-%
Mn: <0.06 wt.-%
Ti: <0.16 wt.-%
Cu: <0.006 wt.-%
Sr: 0.010 wt.-% to 0.030 wt.-%
Zr: <0.006 wt.-%
Zn: <0.006 wt.-%
Contaminants: <0.1 wt.-%, preferably <0.005 wt.-%
and is supplemented to 100 wt.-%, in each instance, with Al.

Such an Al casting alloy is stronger, more impact-resistant, and more ductile as compared with the state of the art.

The selection of alloy components according to the invention, at the stated magnitude, leads to a further significant improvement in the mechanical properties, which is already recorded in the cast state, but particularly, in the case of a cast component, after two-stage heat treatment, namely solution annealing and subsequent aging. Preferably, quenching of the cast component in water is provided between these two heat treatment stages. For chassis applications, preferably for wheel-guiding components, very preferably for wheel mounts and, in particular, pivot bearings, higher mechanical characteristic values are obtained in this manner.

The alloys according to the invention can contain production-related contaminants as they are generally known to a person skilled in the art. Such production-related components include, for example Pb, Ni, etc.

For optimization of the mechanical characteristic values, it can be advantageous if Si is contained at a content of more than 3.1 wt.-% to less than 3.7 wt.-%. It can be advantageous for specific application cases if Si is contained at a content of more than 3.3 wt.-% to less than 3.7 wt.-%. For some other application cases, it can be advantageous if Si is contained at a content of more than 3.0 wt.-% to less than 3.3 wt.-%.

For optimization of the mechanical characteristic values, it can be advantageous if Mg is contained at a content of 0.5 wt.-% to 0.6 wt.-%. It can be advantageous if Mg is contained at a content of 0.5 wt.-% to less than 0.6 wt.-%, preferably of 0.5 wt.-% to 0.55 wt.-%.

For optimization of the mechanical characteristic values, it can be advantageous if Cr is present at a content of 0.25 wt.-% to less than 0.30 wt.-%.

For optimization of the mechanical characteristic values, it can be advantageous if Fe is present at a content of 0.01 wt.-% to 0.15 wt.-%.

For optimization of the mechanical characteristic values, it can be advantageous if Mn is present at a content of 0.01 wt.-% to 0.05 wt.-%.

For optimization of the mechanical characteristic values, it can be advantageous if Ti is present at a content of 0.05 wt.-% to 0.15 wt.-%.

For optimization of the mechanical characteristic values, it can be advantageous if Cu is present at a content of 0.001 wt.-% to 0.005 wt.-%.

For optimization of the mechanical characteristic values, it can be advantageous if Sr is present at a content of 0.015 wt.-% to 0.025 wt.-%.

For optimization of the mechanical characteristic values, it can be advantageous if Zr is present at a content of 0.001 wt.-% to 0.005 wt.-%.

For optimization of the mechanical characteristic values, it can be advantageous if Zn is present at a content of 0.001 wt.-% to 0.005 wt.-%.

For specific cast components, it has proven to be advantageous if the Al casting alloy according to the invention is a low-pressure Al casting alloy.

Accordingly, the invention also relates to a method for the production of a cast component from an Al casting alloy according to the invention, in which the low-pressure casting method is used.

For specific cast components, it has proven to be advantageous if the Al casting alloy according to the invention is a low-pressure/counter-pressure (CPC) Al casting alloy.

Accordingly, the invention also relates to a method for the production of a cast component from an Al casting alloy according to the invention, in which the low-pressure/counter-pressure casting method is used.

Fundamentally, various permanent mold casting methods are suitable as production methods for cast components, particularly as chassis parts, preferably as wheel-guiding parts, very preferably as pivot bearings of motor vehicles, composed of the casting alloy according to the invention. Because of the very good mechanical properties in the case of wheel-guiding parts of motor vehicles subjected to great stress, however, low-pressure chill casting and the low-pressure/counter-pressure casting method (CPC method), which is also called the counter-pressure chill casting method are particularly suitable as production methods.

Squeeze casting, gravity chill casting, or die-casting, particularly thixo, rheo, or low-pressure sand-casting, can be used as production methods for cast components, particularly as chassis parts, preferably as wheel-guiding parts, very preferably as pivot bearings of motor vehicles composed of the casting alloy according to the invention.

In order to achieve the advantages mentioned above or to develop them even further, it is advantageous if the cast components are subjected to two-stage heat treatment, namely solution annealing and subsequent heat aging. It can be advantageous if the cast component is quenched in water between the heat treatment stages.

It can be practical if the cast component, after the casting process, is solution-annealed between 530° C. and 550° C. for 6 hours to 10 hours, preferably between 540° C. and 550° C. for 7 hours to 9 hours, particularly for 8 hours to 9 hours, very particularly preferably between more than 540° C. and 550° C. for 7 hours to 9 hours, particularly for 8 hours to 9 hours.

It can be practical if the cast component, after the casting process, is tempered between 180° C. and 210° C. for 1 hour to 8 hours, particularly for 1 hour to 6.5 hours, preferably between 180° C. and 190° C. for 1 hour to 6.5 hours, particularly for 4 hours to 6.5 hours, particularly preferably between 180° C. and less than 190° C. for 4 hours to 6.5 hours, particularly for 5 hours to 6.5 hours.

The invention furthermore provides for the use of an Al casting alloy according to one aspect of the invention or of a particularly heat-treated component according to another aspect of the invention, for chassis parts of motor vehicles, preferably for wheel-guiding components of motor vehicles, very particularly preferably for pivot bearings of motor vehicles.

According to the invention, the cast components have an improved strength/elongation ratio with improved structural properties. The casting method allows a cast piece that is free of large defects, known as cavities. In addition, the microstructure is positively influenced in such a manner that the internal notches that reduce elongation to rupture are kept as low as possible.

As has already been mentioned, the Al casting alloy according to the invention has proven to be particularly suitable for components that are subject to greater stress, such as wheel mounts or pivot bearings. Low-pressure/counter-pressure chill casting (CPC method) is used as a very particularly preferred method for the production of such components subjected to greater stress.

Cast components according to the invention, which are produced from an Al casting alloy according to one aspect of the invention and/or according to a method according to another aspect of the invention are characterized, after heat treatment, by a tensile yield strength $R_p0.2$ of 300 MPa to 325 MPa and/or an elongation to rupture A5 of 4% to 10% and/or a tensile strength $R_m$ of 350 MPa-375 MPa.

EXAMPLE

To determine the mechanical properties of the alloy AlSi3Mg0.5Cr0.3, what is called a "French test rod" is cast according to DIN 50125 in what is called a "French chill mold," using the gravity chill casting method. Subsequently, heat treatment takes place (solution annealing 540° C. for 8 hours, quenching in water, hot aging 180° C. for 6.5 hours), whereby the gate and the sprue are cut off only after the heat treatment, in order to counteract possible sample distortion. The mechanical properties of tensile strength $R_m$, tensile yield strength $R_p0.2$, and elongation to rupture A5 are determined according to DIN 10002.

For a comparison, the values disclosed in DE 10 2008 055 928 A1 for AlSi3Mg0.6Cr0.7 are used.

| | $R_m$ (MPa) | $R_p0.2$ (MPa) | A5 (%) |
|---|---|---|---|
| Al—Si3Mg0.6Cr0.7 from DE 10 2008 055 928 A1 | 315.2 | 215.4 | 10.8 |
| AlSi3Mg0.5Cr0.3 | 360 | 320 | 6 |

As has already been mentioned, the invention particularly relates also to the use of the Al casting alloy according to the invention for cast components that are subject to greater stress, such as wheel mounts or pivot bearings, particularly for those of a dual transverse control arm axle for steerable wheels, particularly front wheels, of a motor vehicle.

Pivot bearings composed of the Al casting alloy according to the invention can absorb and pass on all the wheel forces and moments, in operationally reliable manner, on the basis of the mechanical characteristic values. Such pivot bearings furthermore contribute to a further reduction in non-sprung masses and demonstrate great rigidity. Furthermore, such pivot bearings demonstrate a ductility that permits sufficient deformation of the pivot bearing before failure. Furthermore, such pivot bearings are corrosion-resistant.

Particularly suitable pivot bearings, particularly for a double transverse control arm axle for steerable wheels, particularly front wheels, of a motor vehicle comprise

- an accommodation or recess for accommodating a wheel bearing and accommodations or recesses for attachment of same on the pivot bearing,
- two accommodations or recesses disposed vertically at a distance from one another, for fastening a brake caliper, which are disposed, viewed in the direction of travel, in front of the accommodation or recess for accommodating the wheel bearing,
- an accommodation or recess for fastening a steering link, which is disposed, viewed in the direction of travel, behind the accommodation or recess for accommodating the wheel bearing,
- an accommodation or recess for fastening a lower transverse control arm, which is disposed underneath the accommodation or recess for accommodating the wheel bearing,
- an accommodation or recess for fastening a support arm that essentially absorbs the longitudinal wheel forces, particularly in the form of a tension strut or pressure strut or of a suspension arm, which is disposed underneath the accommodation or recess for accommodating the wheel bearing and, viewed in the direction of travel, behind the accommodation or recess for fastening of the lower transverse control arm, but in front of the accommodation or recess for fastening of the steering link, and
- an accommodation or recess for fastening an upper transverse control arm, which is disposed above the accommodation or recess for accommodating the wheel bearing, and is connected with this accommodation or recess, proceeding from same, by way of a neck-like section, whereby the pivot bearing is produced as a component that is cast in one piece with these accommodations or recesses and connects them with one another.

It can be advantageous if the pivot bearing has a bulge on its back side, which faces toward the opposite pivot bearing of the same axle in the installed state of the pivot bearing. This bulge extends at least in part from the neck-like section, over the back side of the accommodation or recess for accommodating the wheel bearing, all the way to the accommodations or recesses for fastening of the steering link, of the lower transverse control arm and of the support arm that essentially absorbs the longitudinal wheel forces.

It can be advantageous if the bulge is delimited, on its rear longitudinal side, viewed in the direction of travel, by a reinforcement rib that preferably extends, starting at the neck-like section, all the way to the accommodation or recess for fastening of the steering link.

It can be practical if the bulge is delimited, on its front longitudinal side, viewed in the direction of travel, by a reinforcement rib that preferably extends, starting at the neck-like section, all the way to the accommodation or recess for fastening of the lower transverse control arm.

It can be advantageous if the two accommodations or recesses disposed vertically at a distance from one another, for fastening of the brake caliper, are disposed, viewed in the direction of travel, in front of the reinforcement rib that delimits the bulge at its front longitudinal side, viewed in the direction of travel.

It can be advantageous if the pivot bearing has a reinforcement collar, at least in part, on at least one of its narrow sides, for example on the longitudinal sides.

It can be advantageous if a reinforcement collar extends, at least in part, along the neck-like section, from the upper accommodation or recess of the two accommodations or recesses disposed vertically at a distance from one another, for fastening of the brake caliper, in the direction of the accommodation or recess for fastening of the upper transverse control arm.

It can be advantageous if the width of the reinforcement collar that extends at least in part along the neck-like section from the upper accommodation or recess of the two accommodations or recesses disposed vertically at a distance from one another, for fastening of the brake caliper, decreases in the direction of the accommodation or recess for fastening of the upper transverse control arm.

It can be advantageous if at least one reinforcement collar extends at least in part between the two accommodations or recesses disposed vertically at a distance from one another, for fastening of the brake caliper.

It can be advantageous if the width of the at least one reinforcement collar, proceeding from the accommodation or recess of the two accommodations or recesses disposed vertically at a distance from one another, in each instance, for fastening of the brake caliper, decreases in the direction of the other accommodation or recess of the two accommodations or recesses disposed vertically at a distance from one another, in each instance, for fastening of the brake caliper.

It can be advantageous if the at least one reinforcement collar extends, in each instance, proceeding from the accommodation or recess of the two accommodations or recesses disposed vertically at a distance from one another, in each instance, for fastening of the brake caliper, at least in part in the direction of the back side of the pivot bearing, in other words, in the installed state of the pivot bearing, toward the side facing the opposite pivot bearing of the same axle.

It can be advantageous if the at least one reinforcement collar has a wave shape in a longitudinal side view.

It can be advantageous if a reinforcement collar extends, at least in part, from the lower accommodation or recess of the two accommodations or recesses disposed vertically at a distance from one another, for fastening of the brake caliper, in the direction of the accommodation or recess for fastening of the lower transverse control arm.

It can be advantageous if the width of the reinforcement collar that extends at least in part from the lower accommodation or recess of the two accommodations or recesses disposed vertically at a distance from one another, for fastening of the brake caliper, in the direction of the accommodation or recess for fastening of the lower transverse control arm, decreases in the direction of the accommodation or recess for fastening of the lower transverse control arm.

It can be advantageous if the accommodation or recess disposed on the end side of the neck-shaped section, for fastening of the upper transverse control arm, is configured in sleeve-like manner.

It can be advantageous if the neck-shaped section that connects the accommodation or recess for accommodating the wheel bearing with the accommodation or recess for fastening of the upper transverse control arm is provided, on the front side of the pivot bearing, in other words on the side facing away from the opposite pivot bearing of the same axle in the installed state of the pivot bearing, with at least two reinforcement ribs disposed at a distance from one another, in the direction of travel, which ribs extend, proceeding from the accommodation or recess for accommodating the wheel bearing, preferably along the longitudinal side of the pivot bearing, in each instance, at least partly in the direction of the accommodation or recess for fastening of the upper transverse control arm.

It can be advantageous if at least one, preferably two accommodations or recesses for fastening a sensor cable holder are disposed on the front side of the pivot bearing, preferably on the neck-shaped section.

It can be advantageous if at least one reinforcement rib is disposed on the neck-shaped section of the front side of the pivot bearing, which rib extends, proceeding from the accommodation or recess for accommodating the wheel bearing, preferably from a common starting point provided at about the same distance from the longitudinal sides of the pivot bearing, at least partly in the direction of the two accommodations or recesses for fastening of the sensor cable holder. Preferably, the rib extends directly up to the accommodations or recesses for fastening of the sensor cable holder.

It can be advantageous if the accommodation or recess for accommodating the wheel bearing comprises a flange surface or spanning surface that surrounds the bearing, whereby the flange surface has multiple, preferably four screw passage openings for attaching the wheel bearing unit passing through it, whereby these openings are preferably disposed on the circumference of the flange surface or spanning surface, spaced uniformly apart from one another.

It can be advantageous if the accommodation or recess for fastening of the upper transverse control arm has a sleeve shape provided with a longitudinal slot, whereby the accommodation, on its outside, has an accommodation for a clamping screw for attachment of the upper transverse control arm in the accommodation, disposed on both sides of the longitudinal slot.

It can be advantageous if the pivot bearing is produced using a casting method, using a movable core and/or contour part or slide.

It can be advantageous if the pivot bearing is produced by means of low-pressure sand-casting or, preferably, by means of counter-pressure chill casting (CPC). The use of the casting apparatus disclosed in DE 10 2010 026 480 A1 and U.S. Patent Application Publication No. 2012/0119461 (U.S. Ser. No. 13/382,598) and of the method disclosed there has proven to be particularly advantageous. The disclosure content of DE 10 2010 026 480 A1 and U.S. Patent Application Publication No. 2012/0119461, i.e. the content of these applications is incorporated or integrated into the present application, by explicit reference that it belongs to the object of the present application.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings.

When the same reference symbols are used in FIGS. 1 to 3, these reference symbols also refer to the same parts or regions.

DETAILED DESCRIPTION OF PREFERRED EMBODIMENTS

Figure 1:
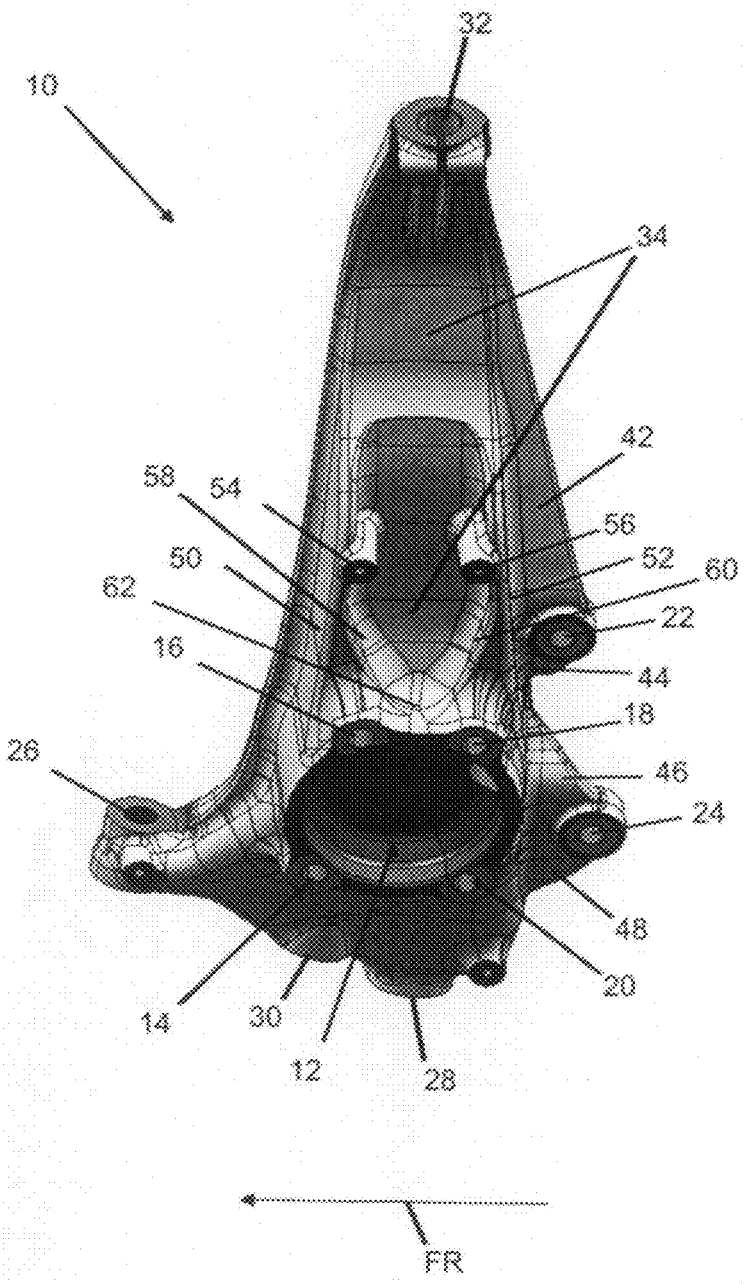
FIG. 1 is a perspective view of the front side of the pivot bearing according to the invention for the left steerable wheel of a double transverse control arm front axle.
Figure 2:
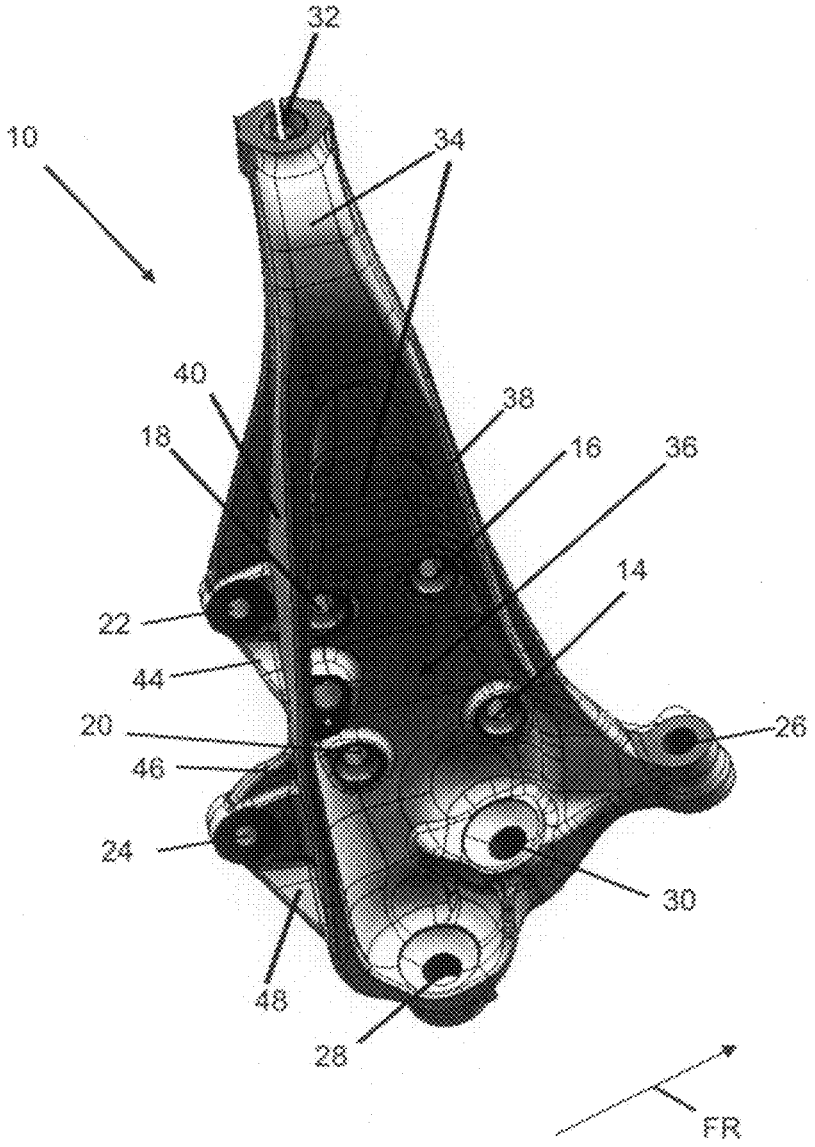
FIG. 2 is a perspective view of the back side of the pivot bearing according to the invention, according to FIG. 1.
Figure 3:
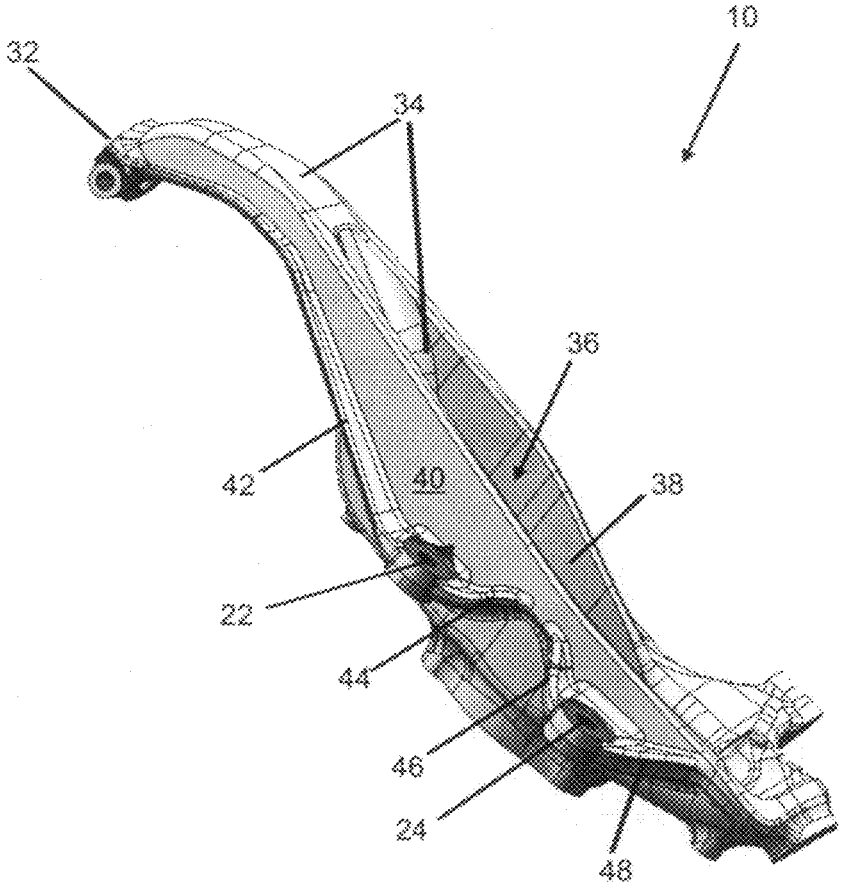
FIG. 3 is a perspective view of the front longitudinal side, viewed in the direction of travel, of the pivot bearing according to FIG. 1, according to the invention.

Referring now in detail to the drawings, the pivot bearing 10 according to the invention, as shown in FIGS. 1-3, is produced from the aluminum alloy according to the invention, using counter-pressure chill casting (CPC).

The pivot bearing 10, which is advantageously provided for a double transverse control arm front axle for steerable wheels of a motor vehicle, comprises

- an accommodation or recess 12 for accommodating a wheel bearing and accommodations or recesses 14, 16, 18, 20 for attachment of the wheel bearing on the pivot bearing 10,
- two accommodations or recesses 22, 24 disposed vertically at a distance from one another, for fastening of a brake caliper, which accommodations or recesses 22, 24 are disposed, viewed in the direction of travel FR, in front of the accommodation or recess 12 for accommodating the wheel bearing,
- an accommodation or recess 26 for fastening of a steering link, which accommodation or recess 26 is disposed, viewed in the direction of travel FR, behind the accommodation or recess 12 for accommodating the wheel bearing,
- an accommodation or recess 28 for fastening of a lower transverse control arm, which accommodation or recess 28 is disposed underneath the accommodation or recess 12 for accommodating the wheel bearing,
- an accommodation or recess 30 for fastening of a support arm that essentially absorbs the longitudinal wheel forces, particularly in the form of a tension strut or pressure strut or of a suspension arm, which accommodation or recess 30 is disposed underneath the accommodation or recess 12 for accommodating the wheel bearing and, viewed in the direction of travel FR, behind the accommodation or recess 28 for fastening of the lower transverse control arm, but in front of the accommodation or recess 26 for fastening of the steering link, and
- an accommodation or recess 32 for fastening of an upper transverse control arm, which accommodation or recess 32 is disposed above the accommodation or recess 12 for accommodating the wheel bearing, and is connected with this accommodation or recess 12, proceeding from this recess 12, by way of a neck-like section 34, whereby the pivot bearing 10 is produced as a component that is cast in one piece with these accommodations or recesses 12, 14, 26, 28, 20, 22, 24, 26, 28, 30, 32, etc., and connects them with one another.

The pivot bearing 10 has a bulge 36 on its back side, which faces toward the opposite pivot bearing, not shown here, of the same axle in the installed state of the pivot bearing 10, which bulge extends in part from the neck-like section 34, over the back side of the accommodation or recess 12 for accommodating the wheel bearing, all the way to the accommodations or recesses 26, 28, 30 for fastening of the steering link, of the lower transverse control arm and of the support arm that essentially absorbs the longitudinal wheel forces, in other words the pressure strut or tension strut or suspension arm.

The bulge 36 is delimited, on its rear longitudinal side, viewed in the direction of travel, by a reinforcement rib 38 that extends, starting at the neck-like section 34, all the way to the accommodation or recess 26 for fastening of the steering link.

The bulge 36 is delimited, on its front longitudinal side, viewed in the direction of travel, by a further reinforcement rib 40 that extends, starting at the neck-like section 34, all the way to the accommodation or recess 28 for fastening of the lower transverse control arm.

The two accommodations or recesses 22, 24 disposed vertically at a distance from one another, for fastening of the brake caliper, are disposed, viewed in the direction of travel FR, in front of the reinforcement rib 40 that delimits the bulge 36 at its front longitudinal side, viewed in the direction of travel.

The pivot bearing 10 has a reinforcement collar, at least in part, on at least one of its narrow sides, for example on the longitudinal sides.

A reinforcement collar 42 extends, at least in part, along the neck-like section 34, from the upper accommodation or recess 22 of the two accommodations or recesses 22, 24 disposed vertically at a distance from one another, for fastening of the brake caliper, in the direction of the accommodation or recess 32 for fastening of the upper transverse control arm.

The width of the reinforcement collar 42 that extends at least in part along the neck-like section 34, from the upper accommodation or recess 22 of the two accommodations or recesses 22, 24 disposed vertically at a distance from one another, for fastening of the brake caliper, in the direction of the accommodation or recess 32 for fastening of the upper transverse control arm, decreases in the direction of the accommodation or recess 32 for fastening of the upper transverse control arm.

Two reinforcement collars 44, 46 that run toward one another extend, at least in part, between the two accommodations or recesses 22, 24 disposed vertically at a distance from one another, for fastening of the brake caliper. The width of these reinforcement collars 44, 46 decreases, proceeding from the accommodation or recess 22, 24, in each instance, of the two accommodations or recesses 22, 24 disposed vertically at a distance from one another, for fastening of the brake caliper, in the direction of the other accommodation or recess 22, 24, in each instance, of the two accommodations or recesses 22, 24 disposed vertically at a distance from one another, for fastening of the brake caliper The reinforcement collars 44, 46 extend, proceeding from the accommodation or recess 22, 24, in each instance, of the two accommodations or recesses 22, 24 disposed vertically at a distance from one another, for fastening of the brake caliper, at least in part in the direction of the back side of the pivot bearing 10, in other words toward the side facing the opposite pivot bearing 10, not shown here, of the same axle, in the installed state of the pivot bearing 10, whereby each of the reinforcement collars 44, 46 has a wave shape in the longitudinal side view. This wave shape is particularly well evident in FIG. 3.

A further reinforcement collar 48 extends, at least in part, from the lower accommodation or recess 24 of the two accommodations or recesses 22, 24 disposed vertically at a distance from one another, for fastening of the brake caliper, in the direction of the accommodation or recess 28 for fastening of the lower transverse control arm. The width of the reinforcement collar 48 that extends from the lower accommodation or recess 24 of the two accommodations or recesses 22, 24 disposed vertically at a distance from one another, for fastening of the brake caliper, in the direction of the accommodation or recess 28 for fastening of the lower transverse control arm, decreases in the direction of the accommodation or recess 28 for fastening of the lower transverse control arm.

The accommodation or recess 32 disposed on the end side on the neck-shaped section 34, for fastening of the upper transverse control arm, is configured in sleeve-like manner.

The neck-shaped section 34 that connects the accommodation or recess 12 for accommodating the wheel bearing with the accommodation or recess 32 for fastening of the upper transverse control arm, is provided, on the front side of the pivot bearing 10, in other words on the side facing away from the opposite pivot bearing, not shown here, of the same axle, in the installed state of the pivot bearing 10, with at least two reinforcement ribs 50, 52 disposed at a distance from one another in the direction of travel FR, which ribs extend, proceeding from the accommodation or recess 12 for accommodating the wheel bearing, along the longitudinal side of the pivot bearing 10, in each instance, at least in part in the direction of the accommodation or recess 32 for fastening of the upper transverse control arm.

Two accommodations or recesses 54, 56 are disposed on the neck-shaped section 34 of the front side of the pivot bearing 10, for fastening of a sensor cable holder. There, two reinforcement ribs 58, 60 are furthermore disposed, which extend, proceeding from the accommodation 12 for accommodating the wheel bearing, namely from a common starting point 62 provided at approximately the same distance from the longitudinal sides of the pivot bearing 10, in the direction of the two accommodations or recesses 54, 56 for fastening of the sensor cable holder, namely directly all the way to the accommodations or recesses 54, 56 for fastening of the sensor cable holder.

The accommodation or recess 12 for accommodating the wheel bearing comprises a flange surface or spanning surface that edges the accommodation or recess 12. The flange surface has multiple, preferably four screw passage openings 14, 16, 18, 20 passing through it, for attachment of the wheel bearing unit. These screw passage openings 14, 16, 18, 20 are preferably disposed so that they are distributed on the circumference of the flange surface or spanning surface, uniformly spaced apart from one another.

The accommodation or recess 32 for fastening of the upper transverse control arm has a sleeve shape provided with a longitudinal slot, whereby the accommodation or recess 32 has an accommodation for a clamping screw for attachment of the upper transverse control arm in the accommodation or recess 32 on its outside, disposed on both sides of the longitudinal slot.

Although only a few embodiments of the present invention have been shown and described, it is to be understood that many changes and modifications may be made thereunto without departing from the spirit and scope of the invention.

What is claimed is:

1. A cast component produced from an aluminum casting alloy that contains the following alloy components Si: more than 3.3 wt.-% to less than 3.7 wt.-%
Mg: 0.3 wt.-% to 0.6 wt.-%
Cr: 0.25 wt.-% to less than 0.30 wt.-%
Fe: <0.18 wt.-%
Mn: <0.06 wt.-%
Ti: <0.16 wt.-%
Cu: <0.006 wt.-%
Sr: 0.010 wt.-% to 0.030 wt.-%
Zr: <0.006 wt.-%
Zn: <0.006 wt.-%
Contaminants: <0.1 wt.-%,
and is supplemented to 100 wt.-% with Al,
wherein the cast component has at least one of a tensile yield strength $R_p0.2$ of 300 MPa to 325 MPa and a tensile strength $R_m$ of 350 MPa-375 MPa.

2. The cast component of claim 1, wherein the contaminants in the aluminum casting alloy are <0.005 wt.-%.

3. The cast component according to claim 1, wherein Mg is contained in the aluminum casting alloy at a content of 0.5 wt.-% to 0.6 wt.-%.

4. The cast component according to claim 1, wherein Fe is contained in the aluminum casting alloy at a content of 0.01 wt.-% to 0.15 wt.-%.

5. The cast component according to claim 1, wherein Mn is contained in the aluminum casting alloy at a content of 0.01 wt.-% to 0.05 wt.-%.

6. The cast component according to claim 1, wherein Ti is contained in the aluminum casting alloy at a content of 0.05 wt.-% to 0.15 wt.-%.

7. The cast component according to claim 1, wherein Cu is contained in the aluminum casting alloy at a content of 0.001 wt.-% to 0.005 wt.-%.

8. The cast component according to claim 1, wherein Sr is contained in the aluminum casting alloy at a content of 0.015 wt.-% to 0.025 wt.-%.

9. The cast component according to claim 1, wherein Zr is contained in the aluminum casting alloy at a content of 0.001 wt.-% to 0.005 wt.-%.

10. The cast component according to claim 1, wherein Zn is contained in the aluminum casting alloy at a content of 0.001 wt.-% to 0.005 wt.-%.

11. The cast component according to claim 1, wherein the aluminum casting alloy is a low-pressure aluminum casting alloy.

12. The cast component according to claim 1, wherein the aluminum casting alloy is a low-pressure/counter-pressure (CPC) aluminum casting alloy.

13. A method for the production of a cast component composed of an aluminum casting alloy, wherein the aluminum casting alloy contains the following alloy components Si: more than 3.3 wt.-% to less than 3.7 wt.-%
Mg: 0.3 wt.-% to 0.6 wt.-%
Cr: 0.25 wt.-% to less than 0.30 wt.-%
Fe: <0.18 wt.-%
Mn: <0.06 wt.-%

Ti: <0.16 wt.-%
Cu: <0.006 wt.-%
Sr: 0.010 wt.-% to 0.030 wt.-%
Zr: <0.006 wt.-%
Zn: <0.006 wt.-%
Contaminants: <0.1 wt.-%,
and is supplemented to 100 wt.-% with Al,
wherein a low-pressure casting method is used to produce the cast component, and
wherein the cast component has at least one of a tensile yield strength $R_p0.2$ of 300 MPa to 325 Mpa and a tensile strength $R_m$ of 350 MPa-375 MPa.

14. A method for the production of a cast component composed of an aluminum casting alloy, wherein the aluminum casting alloy contains the following alloy components
Si: more than 3.3 wt.-% to less than 3.7 wt.-%
Mg: 0.3 wt.-% to 0.6 wt.-%
Cr: 0.25 wt.-% to less than 0.30 wt.-%
Fe: <0.18 wt.-%
Mn: <0.06 wt.-%
Ti: <0.16 wt.-%
Cu: <0.006 wt.-%
Sr: 0.010 wt.-% to 0.030 wt.-%
Zr: <0.006 wt.-%
Zn: <0.006 wt.-%
Contaminants: <0.1 wt.-%,
and is supplemented to 100 wt.-% with Al,
wherein squeeze casting, gravity die casting or pressure casting is used to produce the cast component, and
wherein the cast component has at least one of a tensile yield strength $R_p0.2$ of 300 MPa to 325 Mpa and a tensile strength $R_m$ of 350 MPa-375 MPa.

15. The method according to claim 14, wherein thixo, rheo, or low-pressure sand casting is used to produce the cast component.

16. A method for the production of a cast component composed of an aluminum casting alloy, wherein the aluminum casting alloy contains the following alloy components
Si: more than 3.3 wt.-% to less than 3.7 wt.-%
Mg: 0.3 wt.-% to 0.6 wt.-%
Cr: 0.25 wt.-% to less than 0.30 wt.-%
Fe: <0.18 wt.-%
Mn: <0.06 wt.-%
Ti: <0.16 wt.-%
Cu: <0.006 wt.-%
Sr: 0.010 wt.-% to 0.030 wt.-%
Zr: <0.006 wt.-%
Zn: <0.006 wt.-%
Contaminants: <0.1 wt.-%,
and is supplemented to 100 wt.-% with Al,
wherein a low-pressure/counter-pressure casting method is used to produce the cast component, and
wherein the cast component has at least one of a tensile yield strength $R_p0.2$ of 300 MPa to 325 Mpa and a tensile strength $R_m$ of 350 MPa-375 MPa.

17. The method according to claim 16, wherein the cast component is subjected, after the casting process, to a two-stage heat treatment comprising solution annealing and subsequent artificial aging.

18. The method according to claim 17, wherein the cast component is quenched between the solution annealing and the artificial aging.

19. The method according to claim 16, wherein the cast component, after the casting process, is solution-annealed between 530° C. and 550° C. for 6 hours to 10 hours.

20. The method according to claim 16, wherein the cast component, after the casting process, is solution-annealed between 540° C. and 550° C. for 7 hours to 9 hours.

21. The method according to claim 20, wherein the cast component, after the casting process, is solution-annealed for 8 hours to 9 hours.

22. The method according to claim 16, wherein the cast component, after the casting process, is solution-annealed between more than 540° C. and 550° C. for 7 hours to 9 hours.

23. The method according to claim 22, wherein the cast component, after the casting process, is solution-annealed for 8 hours to 9 hours.

24. The method according to claim 16, wherein the cast component, after the casting process, is tempered between 180° C. and 210° C. for 1 hour to 8 hours.

25. The method according to claim 24, wherein the cast component, after the casting process, is tempered for 1 hour to 6.5 hours.

26. The method according to claim 16, wherein the cast component, after the casting process, is tempered between 180° C. and 190° C. for 1 hour to 6.5 hours.

27. The method according to claim 26, wherein the cast component, after the casting process, is tempered for 4 hours to 6.5 hours.

28. The method according to claim 16, wherein the cast component, after the casting process, is tempered between 180° C. and less than 190° C. for 4 hours to 6.5 hours.

29. The method according to claim 28, wherein the cast component, after the casting process, is tempered for 5 hours to 6.5 hours.

30. A heat-treated component for a chassis part of a motor vehicle comprising an aluminum casting alloy that contains the following alloy components
Si: more than 3.3 wt.-% to less than 3.7 wt.-%
Mg: 0.3 wt.-% to 0.6 wt.-%
Cr: 0.25 wt.-% to less than 0.30 wt.-%
Fe: <0.18 wt.-%
Mn: <0.06 wt.-%
Ti: <0.16 wt.-%
Cu: <0.006 wt.-%
Sr: 0.010 wt.-% to 0.030 wt.-%
Zr: <0.006 wt.-%
Zn: <0.006 wt.-%
Contaminants: <0.1 wt.-%,
and is supplemented to 100 wt.-% with Al
wherein the heat-treated component has at least one of a tensile yield strength $R_p0.2$ of 300 MPa to 325 Mpa and a tensile strength $R_m$ of 350 MPa-375 MPa.

31. The heat-treated component according to claim 30, wherein the chassis part comprises a wheel-guiding component.

32. The heat-treated component according to claim 30, wherein the chassis part comprises a wheel mount.

33. The heat-treated component according to claim 30, wherein the chassis part comprises a pivot bearing.

* * * * *